United States Patent [19]

Lechner

[11] Patent Number: 4,658,482

[45] Date of Patent: Apr. 21, 1987

[54] TENTER FRAME CLIP

[75] Inventor: Alfred Lechner, Punta Gorda, Fla.

[73] Assignee: E. I. Du Pont de Nemours and Company, Wilmington, Del.

[21] Appl. No.: 769,412

[22] Filed: Aug. 26, 1985

[51] Int. Cl.[4] ..... D06C 3/04

[52] U.S. Cl. ..... 26/93

[58] Field of Search ..... 26/79, 93, 94, 95, 73

[56] References Cited

U.S. PATENT DOCUMENTS

| | | | |
|---|---|---|---|
| 2,096,283 | 10/1937 | Lane . | |
| 2,708,784 | 5/1955 | Haven . | |
| 2,945,280 | 7/1960 | Liebert | 26/79 X |
| 3,175,245 | 3/1965 | Kreeft et al. | 26/94 |
| 3,494,527 | 2/1970 | Bauer et al. . | |
| 3,688,557 | 9/1972 | Marinus | 26/93 X |
| 4,065,838 | 1/1978 | Jungpeter et al. . | |
| 4,261,214 | 4/1981 | Watanabe et al. . | |
| 4,271,569 | 6/1981 | Grun et al. | 26/95 X |

FOREIGN PATENT DOCUMENTS

| | | | |
|---|---|---|---|
| 59-83624 | 5/1984 | Japan | 26/93 |

*Primary Examiner*—Robert R. Mackey

[57] ABSTRACT

A tenter frame clip wherein the metal-to-metal contact between the clamping arm and the clip body is cushioned by elastomeric material. The cushioning material can be located on the clip body at the point of contact with the arm, or on a rocker member hinged to the arm and located beneath a strike plate attached to the body.

7 Claims, 6 Drawing Figures

TENTER FRAME CLIP

BACKGROUND OF THE INVENTION

This invention relates to tenter frame clips used for clamping a web of material being transported on a tenter frame.

It is known to use tenter frames to stretch webs of materials, e.g., plastic films, fabrics, foils, etc., in the direction of their width. A typical tenter frame is described in Jungpeter et al., U.S. Pat. No. 4,065,838, and generally includes a plurality of tenter frame clips mounted on two endless chains guided by a pair of diverging tracks. The clips are adapted to shift from an open position to a closed position to grip the edges of a web of material such as plastic film. As the web is moved in the machine direction being gripped by the clips which are moving on the diverging tracks, the web can be stretched transversely simultaneous with its longitudinal movement.

In the operation of a tenter frame, means are provided to move the clamping arm of each clip to an open position to receive the edge of the web as it is moved into the location where the web is to be gripped. Means are there provided to shift each clamping arm to the closed position as the clips follow their divergent tracks. Finally, means are provided to shift each clamping arm open again to release the web as each clip follows its path around the endless chain. Such opening and closing means are well known to those skilled in the art. See, for example, Jungpeter et al., U.S. Pat. No. 4,085,838.

Thus, it can be seen that in the typical operation of a tenter frame there is a constantly repeated opening and closing of a great number of tenter frame clips as a continuous web is moved through the frame. The noise generated in the operation of a tenter frame can be at such a high level as to have adverse effects on the personnel in the area when they are exposed for a protracted period of time. This noise problem with its attendant wear and tear on the clip parts was referred to in Lane, U.S. Pat. No. 2,096,283, issued in 1937. Lane's solution was to reduce the number of openings and closings per circuit from four to two and thus cut the problem in half.

In the typical operation of a tenter frame clip in the stretching of plastic film, the primary source of the noise and wear in the operation is in the metal-to-metal contact between the clamping arm and the clip body when the clip is opened.

SUMMARY OF THE INVENTION

It is found that the noise and wear level in the operation of a tenter frame can be substantially reduced by the instant invention which is particularly pointed out in the appended claims and is described in its preferred embodiments in conjunction with the accompanying drawings.

DESCRIPTION OF THE INVENTION

Figure 1:
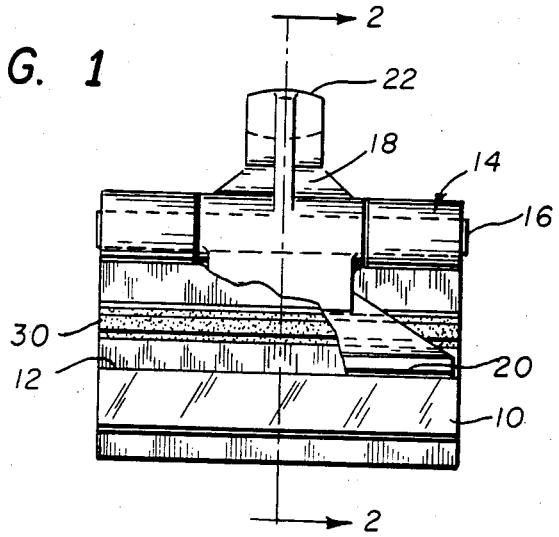
FIG. 1 is an elevation view of a tenter clip showing a partially broken view of the clamping arm 18.

Referring now to the drawings, the tenter clip is made up of a body portion 10 having an upwardly facing flat horizontal clamping surface 12. A projection 14 of the body 10 is located above the clamping surface 12 having a pin 16 journaled at its end. Clamping arm 18 is mounted in a hinged relationship with body projection 14 by pin 16. The lower web-engaging end 20 of clamping arm 18 is made to pivot from a closed web-engaging position in cooperation with surface 12 (shown in FIGS. 2 and 4) to an open web-releasing position (shown in FIG. 6 and in phantom in FIGS. 2 and 4).

The upper end 22 of the clamping arm 18 is rounded to a cam follower and adapted to be engaged by camming means (not shown) to pivot the clamping arm 18 from one position to another. Such means are well known in the art, e.g., U.S. Pat. No. 4,065,838.

In FIGS. 1–4, the clip is shown to have a rocker member 24 hingedly attached at one end 26 to the clip body 10 and at the other end 28 to clamping arm 18. As the clamping arm 18 is pivoted to an open position, end 28 moves vertically upward as shown in phantom on FIGS. 2 and 4. Compressed spring means (not shown) may be included inside rocker member 24 to keep clamping arm 18 from freely pivoting without the application of camming force on upper end 22.

Figure 2:
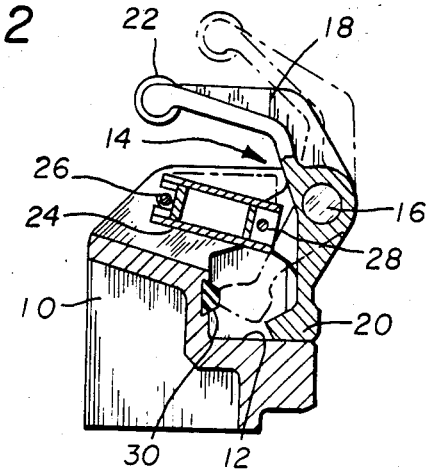
FIG. 2 is an end sectional view along line 2—2 of FIG. 1.

As shown in FIGS. 1 and 2, a cushioning strip of elastomeric material 30 can be attached to the body 10 in the shape of a wedge located in a dovetail machined in the body 10. A suitable elastomer is a polyester elastomer, e.g., that sold by E. I. du Pont de Nemours and Company under the trademark Hytrel®. Elastomeric strip 30 is adapted to receive the impact of lower end 20 when clamping arm 18 is pivoted to the open position as shown in phantom on FIG. 2.

Figure 3:
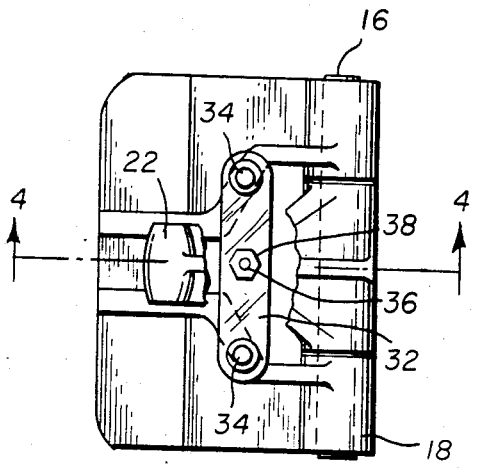
FIG. 3 is a plan view of another embodiment of the tenter clip showing a partially broken view of clamping arm 18.
Figure 4:
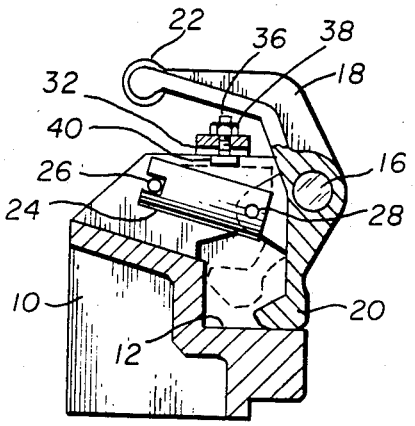
FIG. 4 is an end sectional view along line 4—4 of FIG. 3.

In FIGS. 3 and 4, a strike plate 32 is fastened to body 10 at its projection 14 by machine screws 34. A screw 36 is adjustably attached to the middle of plate 32 with a nut 38. On the head of screw 36 is cemented an elastomeric cushioning button 40, suitably of the same material as strip 30 above. Elastomeric button 40 is adapted to receive the impact of the vertically rising end of rocker member 24 when the lower end 20 of clamping arm 18 is pivoted to the open position as shown in phantom on FIG. 4. This prevents impact between lower end 20 and body 10 when the clip is opened.

Figure 5:
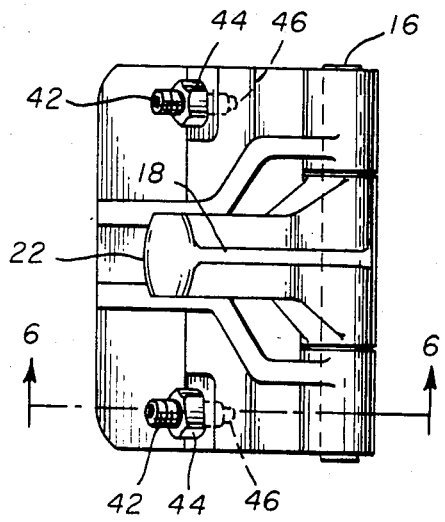
FIG. 5 is a plan view of still another embodiment of the tenter clip.
Figure 6:
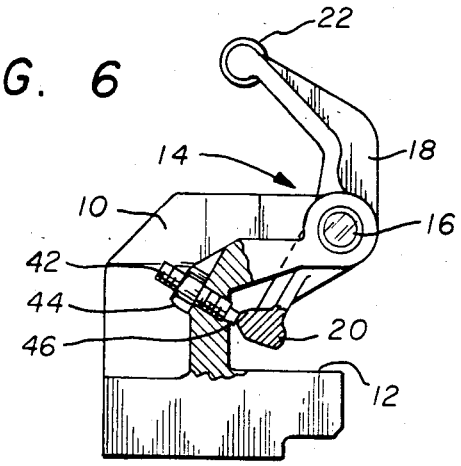
FIG. 6 is an end sectional view along line 6—6 of FIG. 5.

In FIGS. 5 and 6, a pair of screws 42 are in threaded engagement through a central portion of body 10 having adjustment nuts 44. Screws 42 each have cemented to one end an elastomeric cushioning tip 46 adapted to receive the impact of lower end 20 when clamping arm 18 is pivoted to the open position as shown in FIG. 6. Screws 42 may be replaced with spring-loaded plungers. The elastomeric material may be of the same material as strip 30 above. Screws 42 can be located as shown or further down the central portion of body 10 on the essentially vertical portion.

The cushioning means of each of the embodiments described hereinabove are effective in reducing the noise and clatter of the operation of a tenter frame. It has been found that a reduction from about 93 decibels down to about 68 decibels is possible using the instant invention.

I claim:

1. In a tenter frame clip comprising a body portion having an upwardly facing clamping surface and a clamping arm hingedly mounted above said clamping surface and having a lower web-engaging end, said clamping arm pivotable between an open position and a closed web-engaging position, said lower web-engaging end of said clamping arm, adapted to move into contact with said body portion when pivoted to said open position, the improvement of noise-reducing cushioning means of elastomeric material to cushion the contact between said lower web-engaging end of said clamping arm and said body portion.

2. A tenter frame clip as defined in claim 1 wherein said cushioning means is located between said body portion and said lower web-engaging end of said clamping arm.

3. In a tenter frame clip comprising a body portion having an upwardly facing clamping surface and a clamping arm hingedly mounted above said clamping surface and having a lower web-engaging end, said clamping arm pivotable between an open position and a closed web-engaging position, said lower web-engaging end of said clamping arm, adapted to move into contact with said body portion when pivoted to said open position, the improvement of cushioning means to cushion the contact between said lower web-engaging end of said clamping arm and said body portion, said cushioning means being located between said body portion and said lower web-engaging end of said clamping arm, and said cushioning means being a strip of elastomeric material attached to said body portion.

4. In a tenter frame clip comprising a body portion having an upwardly facing clamping surface and a clamping arm hingedly mounted above said clamping surface and having a lower web-engaging end, said clamping arm pivotable between an open position and a closed web-engaging position, said lower web-engaging end of said clamping arm, adapted to move into contact with said body portion when pivoted to said open position, the improvement of cushioning means to cushion the contact between said lower web-engaging end of said clamping arm and said body portion, said cushioning means being located between said body portion and said lower web-engaging end of said clamping arm, said cushioning means comprising at least one cylindrical member which threadably engages said body portion, said cylindrical member having elastomeric material at one end to receive contact with said lower web-engaging end of the clamping arm.

5. In a tenter frame clip comprising a body portion having an upwardly facing clamping surface and a clamping arm hingedly mounted above said clamping surface and having a lower web-engaging end, said clamping arm pivotable between an open position and a closed web-engaging position, said lower web-engaging end of said clamping arm, adapted to move into contact with said body portion when pivoted to said open position, said tenter frame clip also having a rocker member hingedly attached at one end to said body portion and at the other end to said clamping arm such that motion of said clamping arm from said closed position to said open position causes a vertical motion of one end of said rocker member, a strike plate attached to said body portion adapted to receive contact with the end of said rocker member, the improvement of cushioning means to cushion the contact between said lower web-engaging end of said clamping arm and said body portion, said cushioning means located at the point of contact between said strike plate and the end of said rocker member.

6. A tenter frame clip as defined in claim 5 wherein said cushioning means is a piece of elastomeric material attached to one end of a threaded cylindrical member.

7. A tenter frame clip as defined in claim 6 wherein said cylindrical member is threadably engaged to said strike plate.

* * * * *